US006985080B2

(12) United States Patent
Kociecki et al.

(10) Patent No.: US 6,985,080 B2
(45) Date of Patent: Jan. 10, 2006

(54) FLAME SENSE CIRCUIT AND METHOD WITH ANALOG OUTPUT

(75) Inventors: John Kociecki, Powell, OH (US); Yelena N. Kaplan, Columbus, OH (US)

(73) Assignee: Ranco Incorporated of Delaware, Wilmington, DE (US)

( * ) Notice: Subject to any disclaimer, the term of this patent is extended or adjusted under 35 U.S.C. 154(b) by 279 days.

(21) Appl. No.: 10/384,303

(22) Filed: Mar. 7, 2003

(65) Prior Publication Data

US 2004/0174265 A1 Sep. 9, 2004

(51) Int. Cl.
*G08B 17/12* (2006.01)

(52) U.S. Cl. ..... 340/577; 340/595; 340/596; 340/600; 341/18; 341/25; 341/42

(58) Field of Classification Search ..... 340/577, 340/578, 579, 584, 588, 589, 595, 596, 597–600; 431/18, 25, 42; 374/121, 120; 338/179, 25; 361/282

See application file for complete search history.

(56) References Cited

U.S. PATENT DOCUMENTS 4,689,006 A * 8/1987 Gann ..... 431/46
5,439,374 A * 8/1995 Jamieson ..... 431/25
5,472,336 A * 12/1995 Adams et al. ..... 431/16
5,577,905 A * 11/1996 Momber et al. ..... 431/66

* cited by examiner

*Primary Examiner*—Jeffery Hofsass
*Assistant Examiner*—Daniel Previl
(74) *Attorney, Agent, or Firm*—Leydig, Voit & Mayer, Ltd

(57) ABSTRACT

An analog flame sense circuit is provided that utilizes the flame rectification method of sensing flame. The circuit uses an AC voltage source and discrete components to provide the sensing of the flame current. Either a single-pole or a two-pole filter may be used to smooth the generated sense voltage. A DC bias is provided to the filter to ensure a positive voltage. The circuit also includes a high-gain, high-impedance amplifier to translate the high impedance voltage of the sensing portion of the circuit to a relatively low impedance voltage for use by an electronic control circuit. In one embodiment, a high-gain emitter-follower amplifier constructed from two bi-polar junction transistors (BJTs) is used. An integrated Darlington configuration may be used, as well as a single BJT having a high gain, and an integrated operational amplifier.

27 Claims, 3 Drawing Sheets

FLAME SENSE CIRCUIT AND METHOD WITH ANALOG OUTPUT

FIELD OF THE INVENTION

The invention relates generally to flame sense circuits, and more particularly to analog flame sense circuits that utilize the flame rectification method for sensing flame.

BACKGROUND OF THE INVENTION

Many consumer and commercial appliances, including furnaces, water heaters, ovens, etc., include gaseous fuel burners. These appliances typically operate by providing a controlled gaseous fuel flow valve and an ignition source for igniting the flow of gaseous fuel in the burner housing. To ensure safety of operation, these appliances typically also include a flame sensor that is used to detect the presence or absence of flame in the burner housing. The output of this flame sensor may be used by the appliance controller or other circuitry to control the flow of gaseous fuel through the gaseous flow valve, to control the ignition source (such as where electronic spark, hot surface, etc. ignition are used), and to control a purge fan if one is provided. Such controls are necessary to prevent a condition where gaseous fuel is continued to be delivered to the burner housing without being combusted. If such a case were allowed to continue, the accumulation of unburned gaseous fuel in the burner assembly could result in a potentially explosive condition. Further, such control also allows for the diagnosis of potential problems and the identification of the need for cleaning or maintenance on the burner based upon the quality of the flame sensed therein.

While various methods of flame sensing are known in the art, including optical and pyrometer type sensors, a preferred method of sensing flame in consumer and commercial appliances such as those identified above and others is known as the flame rectification method for sensing flame. Indeed, many gas control safety standards written for such applications by, e.g. the American Gas Association now the Canadian Standards Association, specify that the flame rectification methodology of flame sensing be employed. The phenomenon of flame rectification is well known in the art. Specifically, it is known that the outer cone of a flame is ionized and can conduct electricity. Under the principle of flame sensing by flame rectification, two electrodes of different size are placed in contact with this outer envelope of the flame. These two differently sized electrodes are then connected to a circuit that supplies an AC voltage thereacross. In this configuration, the current that flows through the flame tends to flow only in one direction, from the smaller electrode to the larger electrode.

Recognizing that the presence of a flame will allow essentially DC current to flow therethrough, various circuits have been developed that allow for the sensing of both the presence and quality of the flame. These circuits may be broadly classified in one of two technology areas. The first area, to wit analog circuits, employ junction field effect transistors (JFETs). In such analog circuits, a JFET is configured as an amplifier and produces a negative voltage that is somewhat proportional to the flame current. Essentially, the JFET transistors are used to provide a high impedance buffer from the flame sense circuit to the appliance control electronics.

Unfortunately, such prior analog circuits do not provide an accurate measure of the flame current, and are particularly sensitive to normal variations of the component parameters. Two such parameters of a JFET that have a significant impact on the effectiveness of such circuits are the input to output gain and the gate turnoff threshold. Further, these parameters have wide variations with normal production and temperature tolerances. In such conventional circuits, these variations produce inaccuracies in the flame sense circuit. Even when JFETs are specifically manufactured and selected in production for a narrower range of these parameters, the remaining variations still significantly affects the circuit performance. As a result, these analog circuits suffer from poor accuracy.

The second class of flame sense circuits utilizing the flame rectification methodology includes digital circuits. Unfortunately, the typical digital flame sense circuit also uses a JFET transistor. In these digital circuits, the time required for the flame current to charge a capacitor at the input terminal of the JFET is measured. The voltage pulse width at the output terminal of the JFET is somewhat proportional to the flame current. While such digital circuits have been designed to reduce the poor performance effects of the JFET transistors in the analog circuits, the digital circuits still suffer from poor accuracy. Additionally, their added complexity also increases the system cost, reduces reliability, and does not allow for a straightforward measurement of the flame current with common laboratory instruments. Further, while the digital circuits utilize various algorithms in an attempt to compensate for the JFET transistor inaccuracies, the algorithms cannot accurately adapt for all of the various transistor inaccuracies, appliance parameters, specific electrode sizes, type of gas, etc. in a cost-effective reliable circuit that may reliably be employed for such appliances.

There exists, therefore, a need in the art for a simple, reliable, and accurate flame sense circuit that not only provides reliable detection of the presence of a flame, but also provides a simple method of determining the strength and/or quality of the flame.

BRIEF SUMMARY OF THE INVENTION

In view of the above, it is an objective of the present invention to provide a new and improved flame sense circuit. More particularly, it is an object of the present invention to provide a new and improved flame sense circuit that utilizes the property of flame rectification to detect the presence and quality of a flame. Still further, it is an objective of the present invention to provide such a flame sense circuit in a simplified analog manner that utilizes the property of flame rectification which occurs when a flame bridges two asymmetrically sized electrodes that are energized by a source of alternating current (AC).

Preferably, a circuit constructed in accordance with the teachings of the present invention utilizes electrodes that preferably include a small flame probe or an igniter, and a larger burner. This asymmetry causes a net flow of electric current, i.e. essentially a direct current (DC), from the small electrode to the large electrode. Preferably, the flame sense circuit of the present invention detects this DC current (typically approximately one microampere), and converts it to an easily useable voltage. The circuitry of the present invention provides an output voltage signal that is proportional to this flame sense current and positive in magnitude. An appliance control circuit can easily use this voltage signal for determining the magnitude of the flame current, and consequently the status of the flame. The output voltage signal is not sensitive to normal variations of component parameters, nor does it require complex digital circuitry for operation. The out put voltage signal can easily be measured with common instruments during product development, validation, and servicing. Preferably, the circuit of the present invention utilizes a configuration of resistors, capacitors, bipolar junction transistors (BJTs), and voltage sources. Such a circuit is simple and only requires discreet components, rather than integrated circuits. Such a circuit produces an output voltage signal that is proportional to the flame current and positive in magnitude and is not sensitive to normal variations of transistor parameters, therefore producing a more accurate representation of the flame current.

In one embodiment of the present invention, an AC voltage source generates a flame current through a capacitor, a resistor, and the gas flame. Flame rectification causes this to be a substantially DC current in a direction flowing from the flame sense probe across the flame to the burner. This DC current causes a net charge to build up on the capacitor, i.e. a DC voltage. The net DC voltage on this capacitor further causes a sense current to flow through an additional resistor. This sense current has a pulsed waveform at a frequency of the AC voltage source. A two-pole low-pass filter comprising two resistors and two capacitors converts this pulsed current into a DC voltage. A DC voltage source adds a positive bias voltage to all components of this low pass filter.

The resistors discussed thus far have all preferably had large resistances in the megaohm range, for example ranging from approximately 5 to 33 megaohms. However, since such values are not suitable for direct connection to appliance control electronics that have a low effective impedance, bipolar junction transistors are used in a high-gain emitter-follower amplifier configuration that converts the high impedance voltage into a low impedance voltage on an output resistor. This analog output voltage is inversely proportional to the flame current. A higher voltage is produced for small flame currents and a lower voltage for high flame currents. Small flame current is indicative of a weak flame and possible system problems. A high flame current is indicative of a strong flame and a well-functioning system.

A control circuit would typically compare this output voltage against reference values to determine the status of the flame. If there is no flame, or if a flame was established and then lost, the control circuit would immediately turn off the gas supply to the burner. Since this flame sense circuit of the present invention provides a critical safety function, it must not be sensitive to environmental conditions and must fail in a safe manner. All the components in the circuit can be readily chosen to withstand the normal extremes of temperature, humidity, shock, and vibration. An important advantage of this circuit is that the output voltage is not sensitive to normal variations in the parameters of the transistors. Furthermore, if any of the components fail either short or open circuit, the output voltage would go to an abnormally high or low level, indicating a fault condition.

Advantageously, all of the component values of the circuit of the present invention, including the AC and DC voltage sources, can be chosen from a wide range of possible values suitable for optimum circuit operation. Furthermore, the transistors forming the high-gain emitter-follower amplifier can be replaced either with an integrated Darlington transistor, or an integrated circuit amplifier having high impedance and high gain characteristics such as an operation amplifier. Furthermore, a single transistor with sufficiently high gain may also be used in place of the transistors. Additionally, the two-pole filter may be replaced with only a single-pole filter with the values of the resistor and capacitor adjusted accordingly to achieve desired performance, recognizing that a longer flame failure recognition response time may be the result.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is not intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
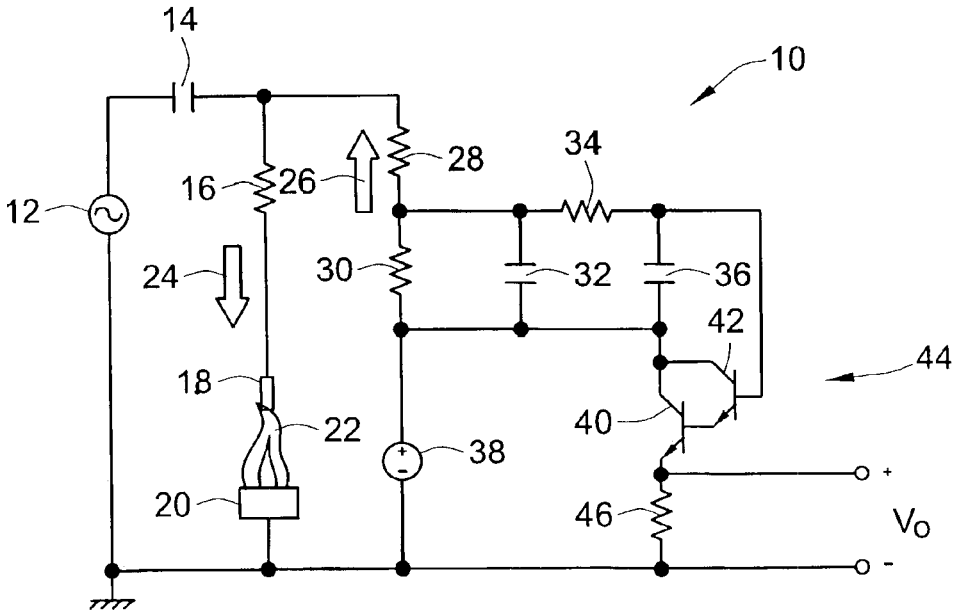
FIG. 1 is a simplified single line schematic illustration of a flame sense circuit constructed in accordance with the teachings of the present invention.

Turning now to the drawings, and with specific reference to FIG. 1, there is illustrated an embodiment of a flame sense circuit 10 of the present invention. In this circuit 10, an AC voltage source 12 is used to supply AC voltage, e.g. 120 volts AC, to the circuit. This AC voltage is provided through capacitor 14 and resistor 16 to excite a flame sense probe 18, which may be a flame probe, a gas igniter, etc. As may be seen in this FIG. 1, the flame probe 18 is small compared with the burner 20 which is used in this embodiment as the other electrode to provide the flame sensing. However, one skilled in the art will recognize that this other electrode 20 may be provided as a separate piece from the burner as is desired.

As a result of the asymmetrically sized electrodes 18, 20, when flame 22 is present, a substantially DC current will flow from electrode 18 to electrode 20. The direction of the flame current is illustrated by arrow 24. This substantially DC flame current causes a net charge to develop on capacitor 14. As result of this net DC voltage on capacitor 14, a substantially DC sense current will flow through resistor 28 in the direction illustrated by the arrow 26. This essentially DC sense current, however, has a pulsed waveform at the frequency of the AC source 12. This is because the flame 22 is actually a poor or leaky rectifier. In a preferred embodiment of the present invention, a two-pole low-pass filter, consisting of resistor 30 and capacitor 32, and resistor 34 and capacitor 36, converts this pulsed sense current into a DC voltage on capacitor 36.

While the voltage resulting from the sense current would tend to be negative, a DC bias is provided to ensure that the sense voltage is a positive value. This bias may be provided by DC voltage source 38, which provides a positive bias voltage to all of the components of the low pass filter (resistor 30, capacitor 32, resistor 34, and capacitor 36). As will be recognized by one skilled in the art from this description, the DC voltage source 38 may comprise simply a resistor and a Zener diode to provide the proper bias. While the magnitude of the DC bias may vary, in one embodiment of the present invention, the bias voltage is set at 15 Vdc.

Since the flame current flowing from electrode 18 to electrode 20 is in the microampere range, the resistance values of the resistors discussed to this point are all relatively large so that a voltage of sufficient magnitude may be generated. Indeed, in one embodiment the values are as follows: resistor 16 is 10 megaohms; resistor 28 is 33 megaohms; resistor 30 is 5.1 megaohms, and resistor 34 is 5.1 megaohms. However, such large resistances are not suitable for direct connection to the appliance's control electronics. This is because such electronics typically have a low effective input impedance. Therefore, the circuit 10 of the present invention provides what may be thought of as a translation of the high impedance voltage generated by the sense current to a relatively low impedance voltage suitable for coupling to the appliance's control electronics.

In one embodiment of the present invention illustrated in FIG. 1, this translation is performed via the bi-polar junction transistors (BJTs) 40, 42 that are configured to form a high-gain emitter-follower amplifier 44. This amplifier 44 converts the high impedance voltage on capacitor 36 into a relatively low impedance voltage on resistor 46 for coupling to the appliance's control electronics. In one embodiment of the present invention, the value of resistor 46 is approximately 50 kΩ.

Figure 2:
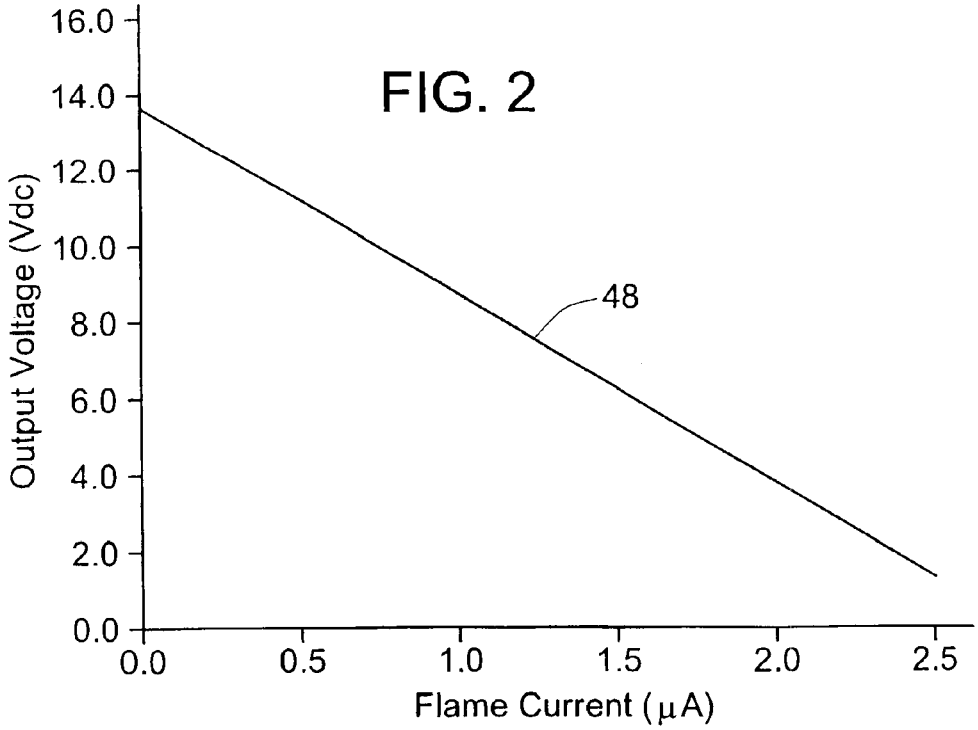
FIG. 2 provides a graphical illustration of the output voltage versus the flame current for the embodiment of the flame sense circuit illustrated in FIG. 1.

As may be seen in FIG. 2, the analog output voltage represented by trace 48 is inversely proportional to the flame current. That is, a higher voltage is produced for small flame currents, and a lower voltage for large flame currents. A small flame current is indicative of a weak flame and possible system problems, while a high flame current is indicative of a strong flame and a well functioning system. As such, the appliance's control electronics can monitor the output voltage, and compare that voltage to an internal reference voltage to determine the status of the flame, and thereby the status of the system. If there is no flame, or a flame was established and then lost, the control circuit would immediately turn off the gas supply to the burner to prevent the development of a hazardous condition. Further, if a weak flame is sensed, the system electronics may provide indication that servicing of the burner is required, may institute a self clean operation, or may simply log this information for subsequent retrieval by maintenance personnel.

As indicated above, the accuracy and reliability of prior flame sense circuits were adversely affected by the various parameters of the JFET transistors typically used therein. The circuit of the present invention suffers from no such accuracy or reliability problems, and is, in fact, not sensitive to normal variations in the parameters of the bipolar junction transistors (BJTs) 40, 42 used to form the high-gain emitter-follower amplifier 44. Furthermore, if any of the components of the embodiment of the present invention illustrated in FIG. 1 fail either open circuit or short circuit, the output voltage would go to an abnormally low or high level, which will be interpreted by the control electronics that a fault condition in the sensing circuit exists. The control circuit may then execute a controlled shut down of the system.

Figure 3:
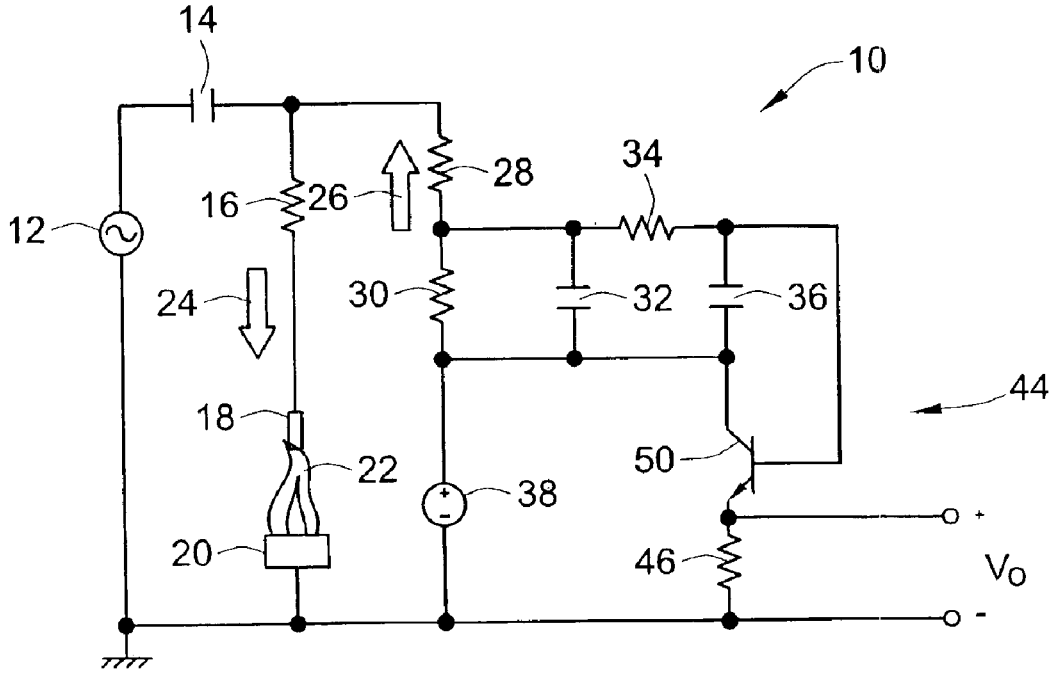
FIG. 3 is a simplified single line schematic illustration of an alternate embodiment of a flame sense circuit constructed in accordance with the teachings of the present invention.
Figure 4:
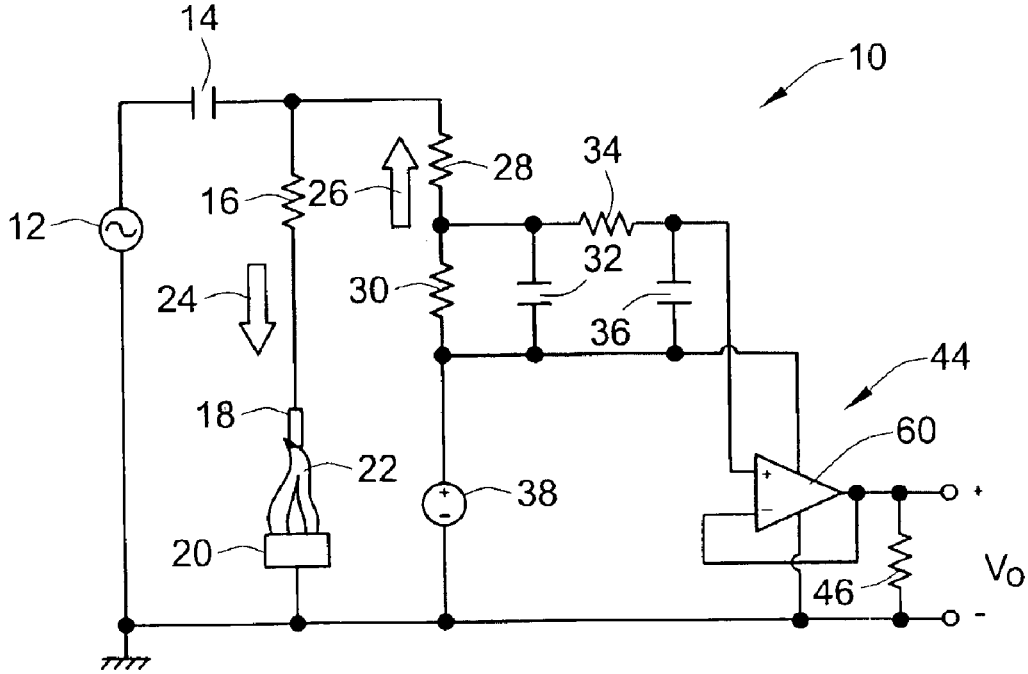
FIG. 4 is a simplified single line schematic illustration of yet a further embodiment of a flame sense circuit constructed in accordance with the teachings of the present invention.

An alternate embodiment of the flame sense circuit of the present invention is illustrated in FIG. 3. As may be seen from an examination of this alternate embodiment, only a single bi-polar junction transistor (BJT) 50 is used in place of the emitter-follower pair of transistors 40, 42 illustrated in FIG. 1 to provide the high-impedance, high-gain characteristics necessary for proper system operation. The higher the gain of the single transistor 50 the better for use with standard control circuitry. Depending on the input characteristics of the control circuitry, a single BJT 50 having a gain of approximately 100 or higher may be used. Indeed, there are single transistors that have gains up over 600 or 700 that are preferred for operation in the embodiment of the flame sense circuit illustrated in FIG. 3. The lower the gain of transistor 50, the higher the impedance of resistor 46 should be so that the smaller amount of gain of the single transistor 50 multiplied by the higher value of resistance of resistor 46 reflected into the low pass filter will still allow the flame sense circuit of the present invention to function in relation to the relatively high impedance sense circuitry to which this circuit supplies its output. In further embodiments of the present invention, this transistor 50 may be replaced by an integrated Darlington transistor, or an integrated circuit amplifier having the high-impedance and high-gain characteristics such as an operational amplifier 60 discussed above and illustrated in FIG. 4.

Figure 5:
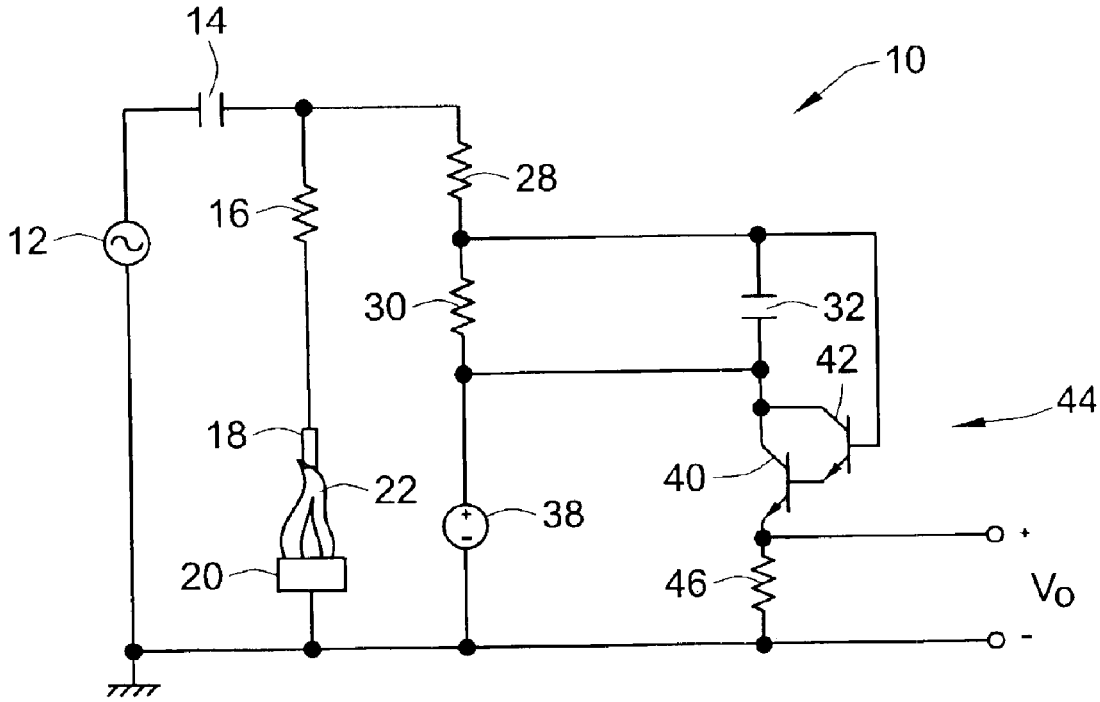
FIG. 5 is a simplified single line schematic illustration of a still further embodiment of a flame sense circuit constructed in accordance with the teachings of the present invention.

FIG. 5 illustrates yet a further embodiment of a flame sense circuit constructed in accordance with the teachings of the present invention. As may be seen in this schematic illustration, only single-pole filter is used having resistor 30 and capacitor 32. In this configuration, the values of the resistor 30 and capacitor 32 may be varied to provide similar performance as the circuits discussed above, recognizing that a longer flame failure recognition response time may result. Other circuit modifications will be apparent to those skilled in the art in view of the foregoing description. For example, a resistor may be added in series with capacitor 14 to account for different system characteristics. Further, resistors 16 and 28 can be comprised of series combinations of resistors to withstand increased voltage and to provide operational redundancy. Additionally, all of the component values, including the AC and DC sources, can be chosen from a wide range of possible values selected to optimize circuit operation for different applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A flame sense circuit, comprising:

a source of AC electric power;

a first capacitor coupled in series between the source of AC electric power and a first node;

a first resistor coupled to the first node;

a first flame sense electrode coupled to said first resistor;

a second flame sense electrode positioned in proximity to the first flame sense electrode such that a flame to be sensed would be in contact with both the first and the second flame sense electrodes;

a second resistor coupled to the first node;

a low-pass filter coupled between the second resistor and a second node;

a DC bias coupled to the second node;

an output resistor across which an output voltage representative of a status of the flame to be sensed is developed; and a high-impedance amplifier circuit having an input coupled to the low-pass filter and an output coupled to the output resistor.

2. The flame sense circuit of claim 1, wherein the first flame sense electrode and the second flame sense electrode are asymmetrically sized.

3. The flame sense circuit of claim 2, wherein the first flame sense electrode is smaller than the second flame sense electrode.

4. The flame sense circuit of claim 1, wherein the first flame sense electrode is an igniter and wherein the second flame sense electrode is a burner body.

5. The flame sense circuit of claim 1, wherein the low-pass filter includes a single-pole filter comprising a third resistor coupled between the second resistor and the second node, and a parallel coupled second capacitor.

6. The flame sense circuit of claim 5, wherein the low pass-filter further includes a second-pole comprising a third resistor coupled to the second resistor and to a third capacitor, the third capacitor further being coupled to the second node.

7. The flame sense circuit of claim 1, wherein the high-impedance amplifier circuit comprises a single bipolar junction transistor (BJT) having a gain of at least 100, the BJT further having its base coupled to the low-pass filter, its collector coupled to the second node, and its emitter coupled to the output resistor.

8. The flame sense circuit of claim 7, wherein the single bipolar junction transistor (BJT) has a gain of at least approximately 600.

9. The flame sense circuit of claim 1, wherein the high-impedance amplifier circuit comprises an integrated Darlington transistor having its base coupled to the low-pass filter, its collector coupled to the second node, and its emitter coupled to the output resistor.

10. The flame sense circuit of claim 1, wherein the high-impedance amplifier circuit comprises a first bipolar junction transistor (BJT) and a second BJT, the collector of both the first and the second BJT being coupled to the second node, the base of the second BJT being coupled to the low-pass filter, the emitter of the second BJT being coupled to the base of the first BJT, and the emitter of the first BJT being coupled to the output resistor.

11. The flame sense circuit of claim 1, wherein the high-impedance amplifier circuit comprises and integrated operational amplifier.

12. The flame sense circuit of claim 1, wherein the DC bias comprises a source of DC electric power.

13. The flame sense circuit of claim 1, wherein the DC bias comprises a resistor and Zener diode.

14. The flame sense circuit of claim 1, where the output voltage across the output resistor is inversely proportional to a flame current.

15. A method of sensing flame, comprising the steps of:

exciting asymmetrically sized flame sense electrodes with an AC voltage through a first capacitor and a first resistor;

generating an essentially DC voltage across the first capacitor in the presence of flame between the asymmetrically sized flame sense electrodes;

generating an essentially DC flame sense current across a sense resistor to develop an essentially DC flame sense voltage in the presence of flame between the asymmetrically sized flame sense electrodes;

biasing the essentially DC flame sense voltage above zero volts;

filtering the biased, essentially DC flame sense voltage;

translating the filtered, biased, essentially DC flame sense voltage from a high impedance circuit to a low impedance circuit for coupling to a control electronic circuit.

16. The method of claim 15, wherein the step of translating comprises the step of translating via a high-gain bipolar junction transistor (BJT).

17. The method of claim 15, wherein the step of translating comprises the step of translating via a pair of bipolar junction transistors (BJTS) coupled in a Darlington configuration.

18. The method of claim 15, wherein the step of translating comprises the step of translating via an integrated Darlington transistor.

19. The method of claim 15, wherein the step of translating comprises the step of translating via an integrated operational amplifier.

20. The method of claim 15, wherein the step of filtering comprises the step of filtering via a single-pole filter.

21. The method of claim 15, wherein the step of filtering comprises the step of filtering via a two-pole filter.

22. A flame sense circuit, comprising:

a first capacitor having a first terminal adapted to be coupled to an external source of AC electric power and a second terminal coupled to a first node;

a first resistor having a first terminal coupled to the first node and a second terminal adapted to be coupled to an external flame sense electrode;

a second resistor coupled to the first node;

a low-pass filter coupled between the second resistor and a second node;

a DC bias coupled to the second node;

an output resistor across which an output voltage representative of a status of the flame to be sensed is developed; and a high-impedance amplifier circuit having an input coupled to the low-pass filter and an output coupled to the output resistor.

23. The flame sense circuit of claim 22, wherein the high-impedance amplifier circuit comprises a single bipolar junction transistor (BJT) having a gain of at least 100, the BJT further having its base coupled to the low-pass filter, its collector coupled to the second node, and its emitter coupled to the output resistor.

24. The flame sense circuit of claim 22, wherein the single bipolar junction transistor (BJT) has a gain of at least approximately 600.

25. The flame sense circuit of claim 22, wherein the high-impedance amplifier circuit comprises an integrated Darlington transistor having its base coupled to the low-pass filter, its collector coupled to the second node, and its emitter coupled to the output resistor.

26. The flame sense circuit of claim 22, wherein the high-impedance amplifier circuit comprises a first bipolar junction transistor (BJT) and a second BJT, the collector of both the first and the second BJT being coupled to the second node, the base of the second BJT being coupled to the low-pass filter, the emitter of the second BJT being coupled to the base of the first BJT, and the emitter of the first BJT being coupled to the output resistor.

27. The flame sense circuit of claim 22, wherein the high-impedance amplifier circuit comprises an integrated operational amplifier.

* * * * *